United States Patent [19]

Wolfe

[11] Patent Number: 4,878,405

[45] Date of Patent: Nov. 7, 1989

[54] COLLET LOCK FOR POWER TOOL

[75] Inventor: Jack Wolfe, Greenville, S.C.

[73] Assignee: Ryobi Motor Products Corp., Pickens, S.C.

[21] Appl. No.: 276,066

[22] Filed: Nov. 21, 1988

[51] Int. Cl.[4] ..... B25B 17/00

[52] U.S. Cl. ..... 81/57.31; 81/57.11; 81/57.14; 173/47

[58] Field of Search ..... 81/54, 57, 57.11, 57.14, 81/57.3, 57.31, 57.42; 173/12, 47, 48

[56] References Cited

U.S. PATENT DOCUMENTS 4,448,098 5/1984 Totsu ..... 81/57.11 X 4,754,669 7/1988 Verdier et al. ..... 81/57.14

4,804,048 2/1989 Porth ..... 173/47

*Primary Examiner*—James G. Smith

*Attorney, Agent, or Firm*—David L. Davis

[57] ABSTRACT

A battery powered motor driven screwdriver having an arrangement for both locking the tool-holding collet and disengaging it from the drive train. The collet is supported in a bushing having internal U-shaped ribs forming pockets, and the collet is formed with radial fins. To disengage and lock the collet, it is grasped by the operator and pulled outwardly out of engagement with the drive train. The fins are dropped into the pockets which prevent rotation by interfering contact between the fins and the ribs.

12 Claims, 3 Drawing Sheets

COLLET LOCK FOR POWER TOOL

BACKGROUND OF THE INVENTION

This invention relates to motor driven tools having a rotatively driven tool-holding collet and, more particularly, to an arrangement for locking the collet from rotation.

In recent years, battery powered motor driven screwdrivers have become increasingly popular. However, due to the limitations of motor size and available battery power, there arise situations where the power tool cannot generate sufficient torque to properly seat a driven screw. Accordingly, it is a primary object of this invention to provide an arrangement whereby the tool operator can lock the tool holding collet to the housing so that sufficient torque can be manually applied to the screw or other driven device.

Typical battery powered screwdrivers include a high speed motor whose output shaft is coupled to a gear train for providing output rotation at a greatly reduced speed. In such an arrangement, if the output shaft is prevented from turning and power is applied to the motor, there exists the danger that either the motor or the gear train will be damaged. Further, if a collet locking arrangement is designed to either lock up the gear train or lock the collet to the housing without separating it from the gear train, if motor power is accidentally applied to the motor when the collet is locked, the same likelihood of damage occurs. Also, if the locking arrangement locks up the gear train, when manual torque is applied to the tool, the gear train is likely to be damaged. Accordingly, it is a further object of this invention to provide a collet locking arrangement which both locks the collet to the housing and disengages it from the drive train.

SUMMARY OF THE INVENTION

The foregoing and additional objects are attained in accordance with the principles of this invention by providing an arrangement for locking a tool holding collet from rotating, the collet being rotatively supported within a bushing, the arrangement comprising a plurality of equiangularly spaced radial fins on the collet, and a corresponding plurality of equiangularly spaced pockets formed by projections on the interior of the bushing, the projections providing bearing surfaces for the collet and being so situated and shaped that when the fins are within the pockets interfering contact is established between the fins and the projections to prevent relative rotation therebetween.

In accordance with various features of this invention the pockets are formed by U-shaped ribs, the pockets are situated to provide an annular region for allowing non-interfering movement of the fins, means are provided for resisting movement of the fins out of the pockets, means are provided for resisting movement of the fins out of the annular region, and means are provided for resisting movement of the fins out of whichever of the pockets or the annular region the fins are in.

Additional objects are attained in a power tool having a housing, a motor driven shaft within the housing, a bushing fixedly supported on the housing, and a collet supported in the bushing for holding a tool, the collet and shaft having complementary shaped portions for matingly engaging the collet with the shaft. In such a tool, there is provided an arrangement for selectively coupling collet to either (a) the shaft for rotation therewith or (b) the bushing for locking the collet from rotation. The inventive arrangement comprises a rib formed on the interior of the bushing, the rib having a U-shaped portion forming a pocket with the closed end of the U facing a first end of the bushing and spaced therefrom, and a radial fin on the collet arranged to allow rotation of the collet in the bushing when the fin is between the rib and the first bushing end and to lock the collet to the bushing by interfering contact with the rib when the fin is within the pocket between those portions of the rib forming the walls of the U.

In accordance with a feature of this invention there are a plurality of equiangularly spaced ribs and a corresponding plurality of equiangularly spaced fins.

In accordance with another feature of this invention, the arrangement further includes means for biasing the collet toward the first bushing end.

In accordance with a further feature of this invention, the biasing means includes a spring.

In accordance with yet another feature of this invention, the spring operates between the shaft and the collet.

In accordance with still another feature of this invention, the collet is formed with a longitudinal bore extending into the collet from one end thereof, the shaft includes a portion extending into the collet bore from the one end of the collet, the shaft portion being formed with an annular groove, the spring being a helical compression spring surrounding the shaft portion between the groove and the one end of the collet, and the arrangement further includes a first retainer mounted in the groove and sized to clear the collet bore while bearing against a first end of the spring and a second retainer supported in the collet bore between the first retainer and the one end of the collet, the second retainer having a central opening providing clearance for the shaft portion while bearing against the second end of the spring.

In accordance with yet another feature of this invention, the portion of the rib forming a first wall of the U extends to a second end of the bushing opposite the first bushing end and the portion of the rib forming the other wall of the U terminates inwardly of the second bushing end to provide sufficient space for the fin to be moved between the interior and exterior of the U.

BRIEF DESCRIPTION OF THE DRAWINGS

The foregoing will be more readily apparent upon reading the following description in conjunction with the drawings in which like elements in different figures thereof have the same reference numeral applied thereto and wherein.

DETAILED DESCRIPTION

Figure 1:
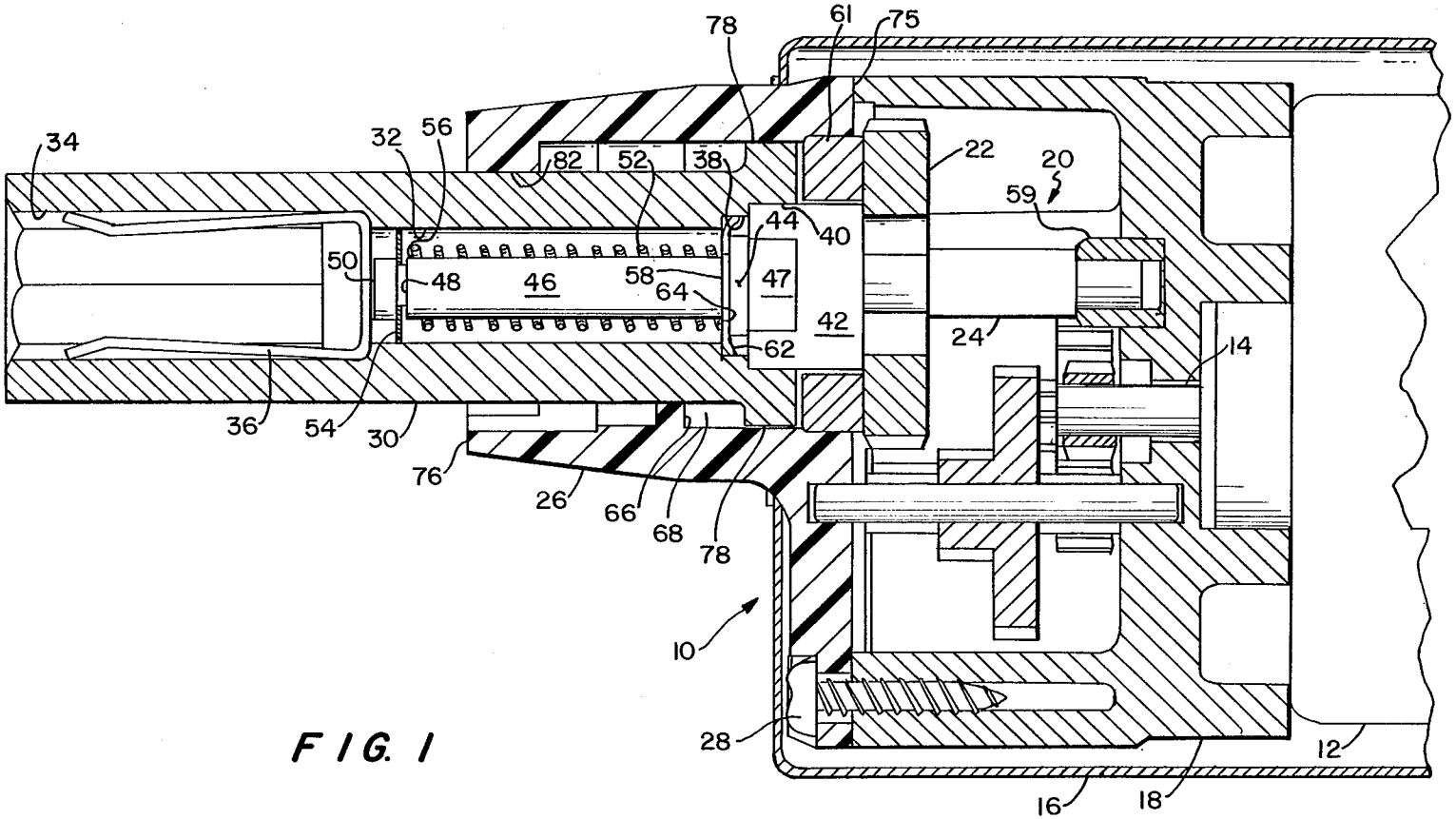
FIG. 1 is a cross-sectional view of the nose end of a battery operated tool having incorporated therein an arrangement constructed in accordance with the principles of this invention and showing the arrangement in the mode where the collet is rotated by the motor.

FIG. 1 illustrates the nose end of a battery powered screwdriver, designated generally by the reference numeral 10, having a motor 12 with a driven shaft 14 mounted within the housing 16 in a conventional manner. Held within the housing 16 is a gear case 18, which may be considered as part of the screwdriver housing for the purposes of the following description of the invention. Supported within the gear case 18 is a conventional gear train 20 which serves to transfer rotative power from the motor shaft 14 to a final gear 22 nonrotatively mounted on the output shaft 24. As is well known, the gear train 20 functions as a speed reducer so that high speed rotation of the motor shaft 14 is converted to low speed rotation of the output shaft 24. The foregoing is conventional and is well known to those of ordinary skill in the art.

In accordance with this invention, there is provided a combination bushing and lock 26, hereinafter called bushing 26, which is fixedly supported on the gear case 18 by means of screws 28 or the like. A collet 30 is supported for rotation in the bushing 26 and is provided with a longitudinal bore 32, one end 34 of which is enlarged and hexagonal in cross-section, and is provided with a hairpin spring 36 therein for gripping a hexagonally shaped shaft of a screwdriver bit. The remainder of the bore 32 is preferably circular in cross-section, having a pair of enlarged step regions 38 and 40 at a first end adjacent the gear case 18. The output shaft 24 has a portion which extends into this circular region of the bore 32. This portion of the shaft 24 includes an enlarged part 42 which fits within the enlarged region 40 of the bore 32, a slightly enlarged part 44 which fits within the enlarged region 38 of the bore 32, and an elongated portion 46 which extends well into the bore 32. The enlarged part 42 of the shaft 24 is slabbed, or flattened, at 47 to engage a complementary flat side wall of the region 40 of bore 32 so that rotation of shaft 24 may be imparted to the collet 30, as is well known.

The elongated portion 46 of the shaft 24 is formed with an annular groove 48 near its distal end 50. A helical compression spring 52 surrounds the shaft portion 46 between the groove 48 and the gear case 18. A C-shaped retainer clip 54 mounted in the groove 48 is sized in its outer dimension so that it is clear of the inner wall of the bore 32 while bearing against a first end 56 of the spring 52. Additionally, the retainer clip 54 is sized in its inner dimension so that it may freely rotate within the groove 48.

A second retainer 58 is provided. The retainer 58 is generally circular, with a central opening 60 and a plurality of outwardly extending teeth 62 which are bent out of the plane of the main portion of the retainer 58. The retainer 58 is supported in the collet 30 within the enlarged step region 38 of the bore 32, with the teeth 62 in biting engagement with the wall of the region 38. The retainer 58 is sized so that its central opening 60 provides clearance for the elongated portion 46 of the shaft 24 while bearing against the second end 64 of the spring 52. The shaft 24 cannot move longitudinally, since one end is journaled for rotation in the bushing 59 and the gear 22 abuts the washer 61. Accordingly, since one end 56 of the spring 52 bears against the retainer clip 54 supported on the shaft 24 and the other end 64 of the spring 52 bears against the retainer 58 supported in the collet 30, the spring 52 operates between the shaft 24 and the collet 30 to bias the collet 30 toward the gear case 18. This tends to bias the collet 30 into mating engagement with the shaft 24 and is the normal mode of operation of the screwdriver 10.

To provide the locking function, the bushing 26 is provided with a plurality of projecting ribs 66 formed on its inner surface 68. The ribs 66 are equiangularly spaced around the inner surface 68 and are preferably six in number, although a different number of ribs may be chosen without departing from the principles of this invention. The ribs are identically configured and each has a U-shaped portion 70, with the closed end 72 facing the gear case 18 at a first end 75 of the bushing 26 while being spaced therefrom, to thereby form a plurality of pockets 73. The ribs 66 are each further configured so that a portion 74 forming a first wall of the U extends to the second end 76 of the bushing 26 opposite the gear case 18. To cooperate with the ribs 66 for providing the locking function, the collet 30 is formed with a plurality of radial fins 78 at its first end, which is closest to the gear case 18. The fins 78 are identically shaped and are equal in number to the ribs 66. During the normal mode of operation of the screwdriver 10, with the collet 30 engaging the output shaft 24, bearing surfaces are provided by the ribs 66 for the main portion of the collet 30 and by the inner surface 68 for the fins 78. During this normal mode of operation, the fins 78 travel in the annular region between the closed ends 72 of the ribs 66 and the first bushing end 75.

Figure 2:
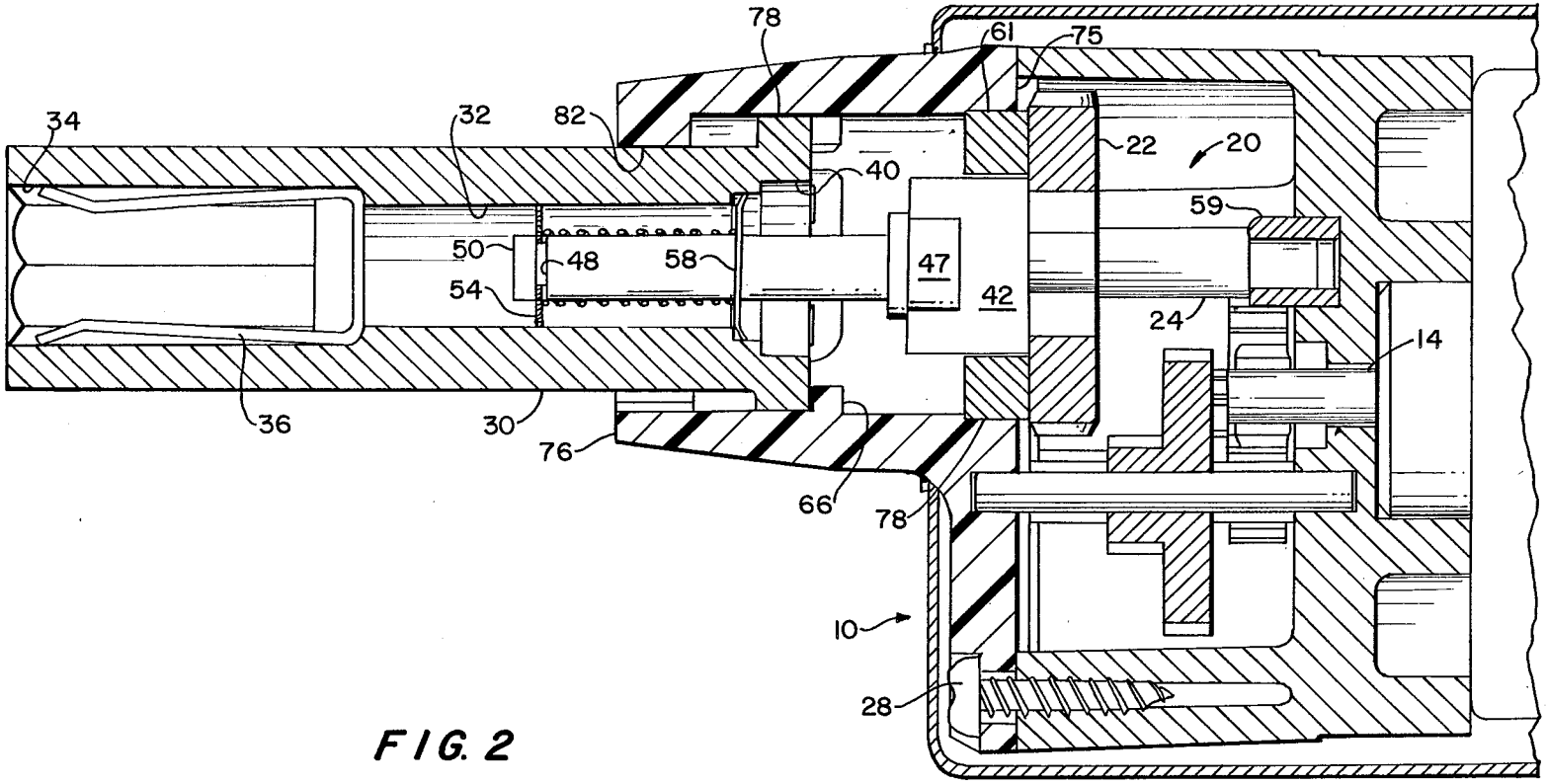
FIG. 2 is a cross-sectional view like FIG. 1, but showing the arrangement in its alternate mode with the collet locked to the bushing.
Figure 5:
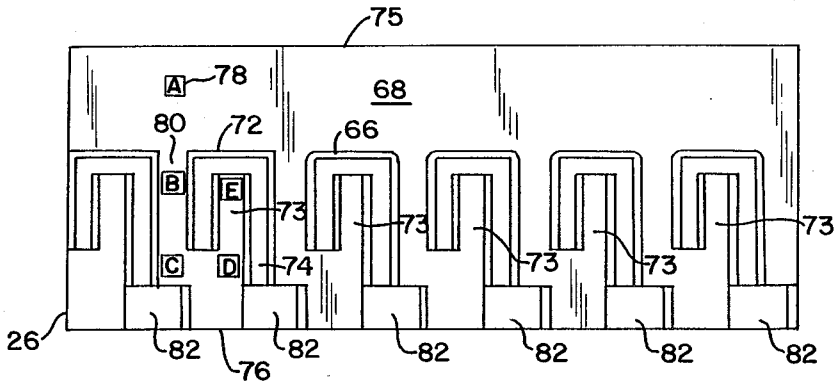
FIG. 5 schematically depicts the interior of the bushing of FIGS. 1 and 2 as if it were cut open and flattened out, showing different positions of an illustrative collet fin to illustrate the alternate modes of operation of the inventive arrangement and intermediate positions of the fin when moving between such alternate modes.
Figure 3:
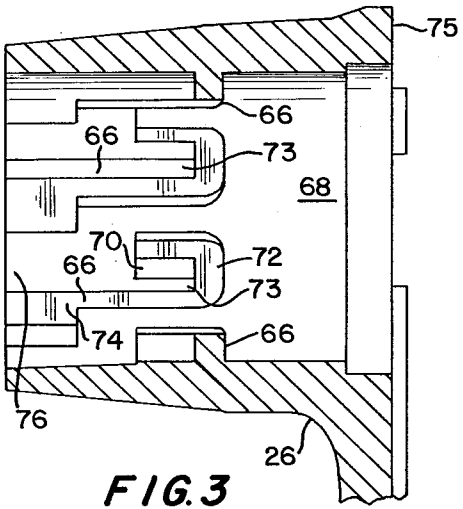
FIG. 3 is a cross-sectional view showing the interior of the bushing shown in FIGS. 1 and 2.
Figure 4:
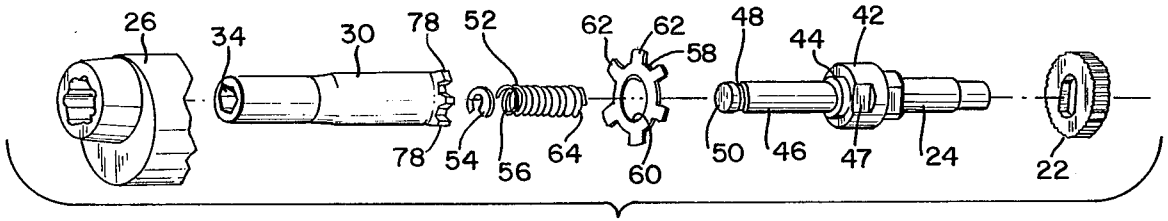
FIG. 4 is an exploded perspective view showing the bushing, the collet, the motor driven shaft and final gear of the gear train, and the biasing spring and retainers, shown in FIGS. 1 and 2.

When the operator desires to lock the collet 30 from rotating, the collet 30 is grasped and pulled outwardly from the bushing 26 against the action of the spring 52, compressing the spring 52. As is best illustrated in FIG. 5, the fins 78 are caused to travel from their position A to their position B which is in a channel 80 formed between adjacent ribs 66. At this time, the collet 30 is disengaged from the shaft 24. The collet is then pulled further until the fins 78 reach their position C where they abut against extensions 82 of portion 74. Extensions 82 perform two functions. The first function is to provide a stop surface to prevent the operator from inadvertently pulling the collet 30 entirely out of the bushing 26. The second function is to provide an increased bearing surface area at the second end 76 of the bushing 26. After the operator has pulled the collet 30 sufficiently that the fins 78 abut the extension 82, the collet is then rotated slightly until the fins reach their position D in abutment with the rib portion 74 of the next rib. After the fins 78 have reached the position D, the operator may then gently release the collet 30, allowing the force exerted by the spring 52 to return the collet 30 inwardly until the fins 78 reach the position E, illustrated in FIG. 2. In this mode, each of the fins 78 is held in a pocket 73 and is biased toward the closed end 72 of the U-shaped portion of that pocket by the spring 52. Accordingly, in this mode, the collet 30 is prevented from rotating by means of the interfering contact between the fins 78 and the ribs 66. At the same time, the collet 30 is disengaged from the shaft 24 so that any torque applied to the collet 30 is not transferred to the gear train 20 and at the same time the motor 12 may be operated without it locking up.

When the operator desires to return the screwdriver 10 to its normal mode of operation, the collet 30 is again grasped and pulled outwardly from the bushing 26 against the action of the spring 52 until the fins 78 are outside the U-shaped portion of the ribs 66. The collet is then turned until the fins 78 are in the channel 80 between adjacent ribs. At that time, the collet 30 is gently released so that the force of the spring 52 may return the collet 30 toward the gear case 18 where it can then reengage with the shaft 24. It is to be noted that some slight turning of the collet 30 may be required to fully engage it with the shaft 24.

The spring 52 thus acts to resist longitudinal movement of the collet to maintain each of the fins 78 within whichever of the annular region or pocket it is in at any given time. It therefore requires a positive act by the operator to change the mode of operation of the screwdriver 10.

Accordingly, there has been disclosed an improved collet lock for a power tool. While a preferred embodiment of the present invention has been disclosed herein, it will be apparent to those of ordinary skill in the art that various modifications and adaptations to that embodiment are possible and it is only intended that the present invention be limited by the scope of the appended claims.

I claim:

1. In a power tool having a housing, a motor driven shaft within said housing, a bushing fixedly supported on said housing, and a collet supported in said bushing for holding a tool, said collet and said shaft having complementary shaped portions for mating engagement of said collet with said shaft, an arrangement for selectively coupling said collet to either (a) said shaft for rotation therewith or (b) said bushing for locking said collet from rotation, said arrangement comprising:

a rib formed on the interior of said bushing, said rib having a U-shaped portion forming a pocket with the closed end of the U facing a first end of said bushing and spaced therefrom; and a radial fin on said collet arranged to allow rotation of said collet in said bushing when said fin is between said rib and said first bushing end and to lock said collet to said bushing by interfering contact with said rib when said fin is within said pocket between those portions of said rib forming the walls of the U.

2. The arrangement according to claim wherein there are a plurality of equiangularly spaced ribs and a corresponding plurality of equiangularly spaced fins.

3. The arrangement according to claim 1 further including means for biasing said collet toward said first bushing end.

4. The arrangement according to claim 3 wherein said biasing means includes a spring.

5. The arrangement according to claim 4 wherein said spring operates between said shaft and said collet.

6. The arrangement according to claim 5 wherein said collet is formed with a longitudinal bore extending into said collet from one end thereof, said shaft includes a portion extending into said collet bore from said one end of said collet, said shaft portion being formed with an annular groove, said spring being a helical compression spring surrounding said shaft portion between said groove and said one end of said collet, said arrangement further including:

a first retainer mounted in said groove and sized to clear said collet bore while bearing against a first end of said spring; and a second retainer supported in said collet bore between said first retainer and said one end of said collet, said second retainer having a central opening providing clearance for said shaft portion while bearing against the second end of said spring.

7. The arrangement according to claim 1 wherein the portion of said rib forming a first wall of the U extends to a second end of said bushing opposite said first bushing end and the portion of said rib forming the other wall of the U terminates inwardly of said second bushing end to provide sufficient space for said fin to be moved between the interior and exterior of the U.

8. An arrangement for locking a tool-holding collet from rotating, said collet being rotatively supported within a bushing, said arrangement comprising:

a plurality of equiangularly spaced radial fins on said collet; and a corresponding plurality of equiangularly spaced pockets formed by projections on the interior of said bushing, said projections providing bearing surfaces for said collet and being so situated and shaped that when said fins are within said pockets interfering contact is established between said fins and said projections to prevent relative rotation therebetween, said pockets being situated to provide an annular region for allowing non-interfering movement of said fins.

9. The arrangement of claim 8 wherein said pockets are formed by U-shaped ribs.

10. The arrangement of claim 8 further including means for resisting movement of said fins out of said pockets.

11. The arrangement of claim 8 further including means for resisting movement of said fins out of said annular region.

12. The arrangement of claim 8 further including means for resisting movement of said fins out of whichever of said pockets or said annular region said fins are in.

* * * * *